US009028616B2

(12) United States Patent
Kitamura et al.

(10) Patent No.: US 9,028,616 B2
(45) Date of Patent: May 12, 2015

(54) METHOD FOR CLEANING INSIDE OF PRESSURE TIGHT CONTAINER FOR BLASTING TREATMENT

(75) Inventors: Ryusuke Kitamura, Kobe (JP); Ryo Shimoike, Kobe (JP); Hisamitsu Shimoyama, Kobe (JP); Nakaba Tsutsui, Kobe (JP); Yoshitaka Yamane, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 162 days.

(21) Appl. No.: 13/695,791

(22) PCT Filed: May 18, 2011

(86) PCT No.: PCT/JP2011/002760

§ 371 (c)(1),
(2), (4) Date: Nov. 1, 2012

(87) PCT Pub. No.: WO2011/145341

PCT Pub. Date: Nov. 24, 2011

(65) Prior Publication Data

US 2013/0042890 A1 Feb. 21, 2013

(30) Foreign Application Priority Data

May 20, 2010 (JP) ..... 2010-116047

(51) Int. Cl.

| | |
|---|---|
| ***B08B 7/00*** | (2006.01) |
| ***F42D 3/00*** | (2006.01) |
| ***B08B 7/02*** | (2006.01) |
| ***B08B 9/08*** | (2006.01) |
| ***F42B 12/20*** | (2006.01) |

(52) U.S. Cl.

CPC ..... *F42D 3/00* (2013.01); *B08B 7/0007* (2013.01); *B08B 7/02* (2013.01); *B08B 9/08* (2013.01); *F42B 12/202* (2013.01)

(58) Field of Classification Search

CPC ..... B08B 7/0007; F42B 33/067; F42B 5/04; F23G 7/003

USPC ..... 134/19

See application file for complete search history.

(56) References Cited

U.S. PATENT DOCUMENTS 3,814,016 A * 6/1974 Leach et al. ..... 102/303
2009/0165636 A1 * 7/2009 Asahina et al. ..... 86/50

FOREIGN PATENT DOCUMENTS

JP 3987870 B1 10/2007

OTHER PUBLICATIONS

International Search Report for corresponding International Application No. PCT/JP2011/002760, Aug. 9, 2011.
Written Opinion for corresponding International Application No. PCT/JP2011/002760, Aug. 9, 2011.

* cited by examiner

*Primary Examiner* — Michael Kornakov
*Assistant Examiner* — Ryan Coleman
(74) *Attorney, Agent, or Firm* — Studebaker & Brackett PC

(57) ABSTRACT

Provided is a method for cleaning the inside of a pressure tight container for a blasting treatment, wherein the inside of a pressure tight container can be cleaned for a short period of time after a blasting treatment. The method is comprised of a setting process wherein a cleaning blast (1) capable of cracking a part of a residual substance remaining on the inside of a pressure tight container (10), and a solid separating material (2) which collides with a substance bonded to an inner wall surface (32*a*) of the pressure tight container (10), to separate the bonded substance from the inner wall surface (32*a*) of the pressure tight container (10), are set on the inside of the pressure tight container (10); and a separation process wherein the cleaning blast (1) blasts on the inside of the pressure tight container (10), to crack a part of the residual substance remaining on the inside of the pressure tight container (10), and the separating material (2) is divided into a plurality of granular elements by the blast, so that the granular elements are spread, and collide with the bonded substance to remove the bonded substance.

6 Claims, 3 Drawing Sheets

METHOD FOR CLEANING INSIDE OF PRESSURE TIGHT CONTAINER FOR BLASTING TREATMENT

TECHNICAL FIELD

The present invention relates to a method for cleaning the inside of a pressure tight container after a blasting step in which an object to be blasted, such as an explosive material, and a blasting explosive are set and blasted inside the pressure tight container.

BACKGROUND ART

Examples of the explosive material include a military explosive material used as a chemical weapon (e.g., artillery shells, bomb, land mine, or underwater mine). Such a military explosive material includes, for example, a steel shell, a bursting charge contained in the shell, and a chemical agent harmful to humans. Examples of the chemical agent include mustard gas and lewisite harmful to humans.

Blasting treatment is known as a method for disposing of the explosive material (e.g., method for making the explosive material harmless). The blasting treatment, which does not involve any disassembling operation, is suitable for disposing of not only explosive materials preserved in good condition, but also those hard to disassemble due to deterioration over time and deformation. The blasting treatment is often performed inside a hermetically-sealed pressure vessel. This is to prevent a chemical agent from leaking out, or to reduce environmental impacts, such as noise and vibration, caused by the blasting.

However, the blasting treatment may not be able to fully destroy the shell of the explosive material. As a result, after the blasting treatment, a chemical agent harmful to humans may remain inside the pressure vessel.

As a solution to this, for example, a residue may be neutralized by an agent or, as disclosed in Patent Literature (PTL) 1, a cleaning explosive may be exploded to decompose a residue using the explosive energy.

In the method of neutralizing the residue, the neutralization takes time depending on the type of residue. To neutralize different types of residue, the neutralization needs to be performed multiple times and requires a long time for the treatment. In the method of decomposing the residue by exploding the cleaning explosive, where different types of residue are simultaneously decomposed by shock waves and gas of very high temperature generated by the explosion, it is possible to reduce the time required for the treatment. However, depending on the chemical agent or the like contained in the explosive material, substances that cannot be decomposed by the shock waves and high-temperature gas may be contained in the residue. As a result, the residue may adhere, as rust or the like, to an inner wall surface of the pressure vessel. If the residue adheres to the inner wall surface of the pressure vessel, the operator has to scrape off the adhering substances. This means that it is not possible to achieve a full reduction in processing time.

CITATION LIST

Patent Literature

PTL 1: Japanese Patent No. 3987870

SUMMARY OF INVENTION

Accordingly, an object of the present invention is to provide a method for cleaning the inside of a pressure tight container for blasting treatment, the method being capable of cleaning the inside of the pressure tight container in a short time.

To achieve the object described above, a method for cleaning the inside of a pressure tight container for blasting treatment according to the present invention, the method being performed after a blasting step in which an object to be blasted and a blasting explosive are set and blasted inside the pressure tight container, includes a setting step of setting a cleaning explosive different from the blasting explosive inside the pressure tight container after the blasting step, and setting a solid separating material inside the pressure tight container and at a position which allows the separating material to be scattered to an inner wall surface of the pressure tight container by explosion of the cleaning explosive and to collide with the inner wall surface of the pressure tight container, the separating material being capable of removing adhering substances adhering to the inner wall surface of the pressure tight container after the blasting step by colliding with the adhering substances; and a removing step of exploding the cleaning explosive inside the pressure tight container to partially decompose a residue of the object to be blasted remaining inside the pressure tight container after the blasting step, breaking the separating material into a plurality of granular elements, and causing the granular elements to scatter to and collide with different parts of the inner wall surface of the pressure tight container to remove the adhering substances.

With this method, the residue can be partially decomposed by shock waves and high-temperature gas generated by explosion of the cleaning explosive. Additionally, it is possible to cause the separating material to scatter to and collide with the inner wall surface of the pressure tight container using the explosive energy of the cleaning explosive, and remove the adhering substances adhering to the inner wall surface of the pressure tight container. That is, by simply exploding the cleaning explosive, it is possible to simultaneously perform both decomposition of the residue in the pressure tight container and removal of the adhering substances adhering to the inner wall surface of the pressure tight container. Therefore, without using a special facility for removal of the adhering substances, the cleaning process including the removing process can be performed in a short time.

DESCRIPTION OF EMBODIMENTS

Hereinafter, a method for cleaning the inside of a pressure tight container for blasting treatment according to the present invention will be described with reference to the drawings.

First, a pressure tight container will be described, which is used in the method for cleaning the inside of a pressure tight container for blasting treatment according to the present invention.

Figure 1:
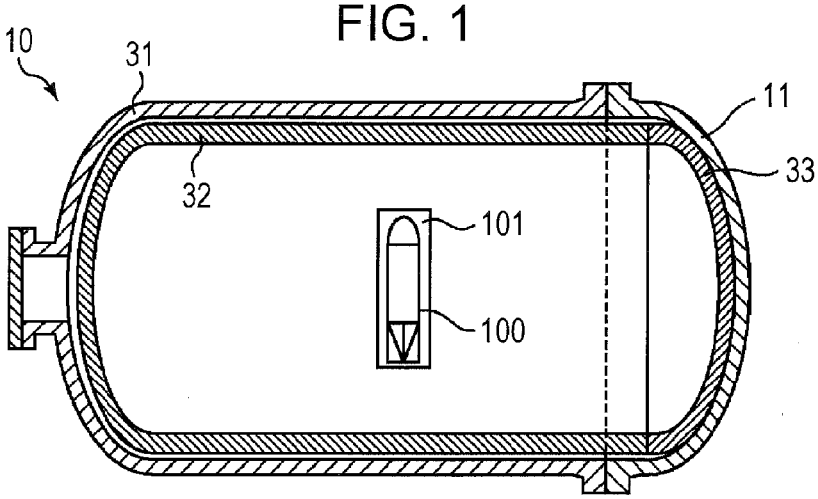
FIG. 1 is a cross-sectional view illustrating a pressure tight container used in a method for cleaning the inside of a pressure tight container for blasting treatment according to the present invention.

FIG. 1 is a schematic cross-sectional view illustrating a state in which a chemical bomb 100 serving as an object to be blasted is placed in a pressure tight container 10. The pressure tight container 10 has a double-layer structure composed of an outer container 31 and an inner container 32. The outer container 31 is a robust pressure tight container made of, for example, iron having strength sufficient to maintain pressure during blasting. The inner container 32 is made of robust material, such as iron, to resist collision with scattering fragments of the chemical bomb 100.

The outer container 31 has a cylindrical shape. The outer container 31 is closed at one end and is open at the other end in its axial direction. A pressure tight lid 11 is removably attached to the open end of the outer container 31. The inner container 32 also has a cylindrical shape. The inner container 32 is closed at one end and is open at the other end in its axial direction. The inner container 32 is disposed inside the outer container 31, with the open end of the inner container 32 facing the pressure tight lid 11. An inner lid 33 is removably attached to the open end of the inner container 32.

The inner container 32 is not tightly secured to the outer container 31, and is loosely fitted inside the outer container 31. That is, the inner container 32 is disposed inside the outer container 31 such that it can be slightly displaced with respect to the outer container 31. Thus, since the inner container 32 is loosely fitted inside the outer container 31, it is possible to prevent the shock of explosion and the impact of collision with scattering objects from being directly transmitted to the outer container 31, prevent application of excessive force to a connected part of the inner container 32 and the outer container 31, reduce the occurrence of damage to the connected part, and improve durability of the pressure tight container 10.

The cleaning method according to the present invention which uses the pressure tight container 10 is a method for cleaning the inside of the pressure tight container 10, the method being performed after a blasting step in which an object to be blasted, such as a chemical bomb, is blasted in the pressure tight container 10.

Figure 2:
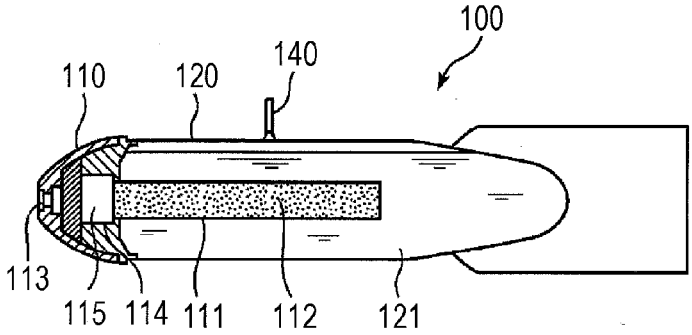
FIG. 2 is a cross-sectional view illustrating a chemical bomb disposed of in the pressure tight container illustrated in FIG. 1.
Figure 3:
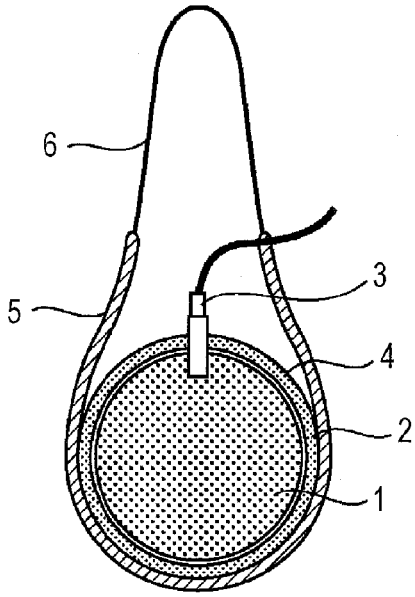
FIG. 3 is a diagram for explaining a method for setting a cleaning explosive and a separating material inside the pressure tight container.

FIG. 2 is a schematic cross-sectional view of the chemical bomb 100. As illustrated in FIG. 2, the chemical bomb 100 includes a nose 110, a burster 111, a bomb shell 120, and a booster cartridge 114. Reference numeral 140 in FIG. 2 denotes a lifting ring used to raise the chemical bomb 100.

The burster 111 extends backward from the nose 110. A bursting charge (explosive) 112 is contained in the burster 111. The booster cartridge 114 is disposed at the front of the burster 111. A booster (explosive) 115 is contained in the booster cartridge 114. A fuze 113 for blasting the bursting charge 112 in the burster 111 is disposed inside the nose 110.

The bomb shell 120 having the burster 111 and the booster cartridge 114 contained therein is connected to the nose 110. The bomb shell 120 is filled with a chemical agent (hazardous substance) 121.

The bursting charge (explosive) 112 may be a military explosive, such as TNT, picric acid, or RDX. The chemical agent (hazardous substance) 121 may be, for example, a blistering agent such as mustard gas or lewisite, a vomiting agent such as diphenylcyanoarsine (DC) or diphenylchlorarsine (DA), phosgene, sarin, or hydrocyanic acid. The chemical agent 121 may either be liquid or solid.

In the blasting step, for example, as illustrated in FIG. 1, the chemical bomb 100 surrounded by a blasting explosive 101 is set inside the pressure tight container 10 by a fixing device (not shown). Then, after the inner lid 33 and the pressure tight lid 11 are mounted and closed, the blasting explosive 101 is blasted by a firing device (not shown) and the chemical bomb 100 is blasted at the same time. The cleaning method according to the present invention is carried out when, after the blasting step is performed once or more than once, a residue remains inside the pressure tight container 10.

The residue remains inside the inner container 32 in the pressure tight container 10 in various forms depending on the type of the chemical bomb 100 and the conditions of the blasting treatment performed before the method of the present invention is performed. Metal parts of the chemical bomb 100, such as the nose 110, the burster 111, the booster cartridge 114, and the bomb shell 120 remain typically in the form of solid metal pieces and metal powder, whereas the bursting charge 112, the booster 115, and the chemical agent 121 remain in gaseous, liquid, or solid form depending on the material used.

In the residue, gases are removed from inside the pressure tight container 10 by an off-gas treatment facility (not shown). Of solids such as metal pieces, large ones are removed from inside the pressure tight container 10 by a removing means, such as a scraping facility (not shown). However, minute particles of liquid and solid residue adhering to the surface of the inner container 32 of the pressure tight container 10 cannot be easily removed by the means described above.

The residue contains substances that are decomposed and made harmless by being subjected to shock waves and high temperatures, and also contains substances that are not decomposed by being subjected to high temperatures. For example, minutes quantities of chemical agents and chloroethyl ethyl sulfide contained in the residue are decomposed and made harmless by being subjected to shock waves and high temperatures. On the other hand, an element (e.g., arsenic) contained in the chemical agent 121, such as DA, DC, or lewisite, is not decomposed by being subjected to shock waves and high temperatures. That is, although the chemical agent 121 can be decomposed by generating shock waves inside the inner container 32 and heating the inside of the inner container 32 to high temperatures, the arsenic or the like is not decomposed, and adheres to and remains on an inner wall surface of the inner container 32 in the form of dust or rust.

In the cleaning method of the present invention, substances that can be decomposed by being subjected to shock waves and high temperatures are decomposed and made harmless. At the same time, in this method, adhering substances that adhere to and remain on an inner wall surface 32*a* of the inner container 32 (i.e., the inner wall surface of the pressure tight container 10) after being subjected to shock waves and high temperatures are separated from the inner wall surface 32*a* of the inner container 32 to facilitate removal of the adhering substances. Thus, the inside of the pressure tight container 10 is cleaned by the method.

Hereinafter, a detailed description will be given of the method for cleaning the inside of the pressure tight container for blasting treatment according to the present invention.

The method for cleaning the inside of the pressure tight container for blasting treatment, according to the present invention, involves use of a cleaning explosive 1 that can explode to generate shock waves and high-temperature combustion gas, and a solid separating material 2 that can be broken into a plurality of granular elements by the explosive energy of the cleaning explosive 1 and collide with the inner wall surface 32*a* of the inner container 32. Examples of the cleaning explosive 1 include an emulsion explosive and a slurry explosive. Examples of the separating material 2 include sand, ceramic powder, and iron powder. Here, sand composed of a plurality of grains is used as the separating material 2.

First, the cleaning explosive 1 with the sand 2 attached therearound is prepared in advance. Specifically, the cleaning explosive 1 is formed into a spherical shape, and the sand 2 (i.e., a plurality of sand grains) is placed in a flexible container (separation container) 4, which is formed into a sheet. In the present embodiment, a bag of plastic or the like is used as the container 4. Then, the sheet-like bag 4 containing the sand 2 is wrapped around the cleaning explosive 1. By analyzing the components and amount of the residue inside the pressure tight container 10, the amount of the cleaning explosive 1 is determined to be an amount that is necessary to decompose the components of the residue into pieces of desired size or smaller. On the basis of the components and amount of the residue inside the pressure tight container 10, the amount of adhering substances in the residue is analyzed, the adhering substances adhering to the inner wall surface 32*a* of the inner container 32. Then, the amount of the sand 2 is determined to be an amount that is necessary to substantially entirely remove the adhering substances.

Figure 4:
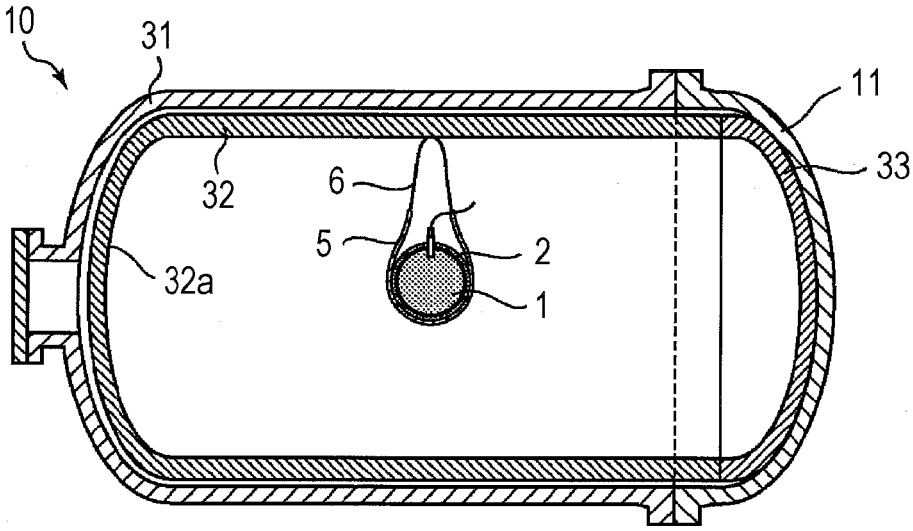
FIG. 4 is a cross-sectional view illustrating a state in which the cleaning explosive and the separating material are set inside the pressure tight container.

Next, the inner lid 33 and the pressure tight lid 11 are opened, and the cleaning explosive 1 covered with the sand 2 is placed, for example, at a position away from the inner wall surface 32*a* of the inner container 32, preferably, in the center of the inner container 32. At the same time, a detonator 3 is attached to the cleaning explosive 1 (setting step). In the present embodiment, as illustrated in FIG. 4, the cleaning explosive 1 covered with the sand 2 is placed in a hanging bag 5, which is hung with a hanging string 6 in the center of the inner container 32. Next, the inner lid 33 and the pressure tight lid 11 are closed to hermetically seal the pressure tight container 10. The operation in which the bag containing the sand 2 is placed around the cleaning explosive 1 may be performed inside the inner container 32.

Next, the detonator 3 is connected to the firing device, which is operated to ignite the detonator 3. Thus, the cleaning explosive 1 is exploded, or more specifically, detonated (removing step).

The detonation of the cleaning explosive 1 causes shock waves to propagate, so that air on the shock wave front is compressed and heated to high temperatures. When the shock waves collide with the inner wall surface 32*a* of the inner container 32, the area of the collision is momentarily heated to as high as about 10000° C. or more by an extreme rise in pressure. The temperature of gas generated by the detonation of the cleaning explosive 1 is as high as several thousand degrees Celsius. When the gas expands to reach the inner wall surface 32*a* of the inner container 32 after the collision of the shock waves, the inner wall surface 32*a* is further subjected to high-temperature gas of several thousand degrees Celsius. Then, the sand 2 with which the cleaning explosive 1 is covered is blown off by the detonation energy of the cleaning explosive 1 and collides at high velocity with the inner wall surface 32*a* of the inner container 32. Specifically, the sand 2 contained in the bag 4 is broken by the detonation energy into many grains forming the sand 2. Then, the many sand grains scatter to and collide with different parts of the inner wall surface 32*a* of the inner container 32 at high velocity.

By being subjected to shock waves and high-temperature gas generated inside the inner container 32, the residue remaining in the inner container 32 is partially decomposed and made harmless. In the residue, substances adhering to different, parts of the inner wall surface 32*a* of the inner container 32, such as rust and arsenic, are blown off by the sand grains scattered at high velocity and are removed from the inner wall surface 32*a*.

In particular, since the sand 2 contained in the bag 4 is broken into a plurality of sand grains and scattered, the adhering substances are removed by the sand grains over a wide area of the inner wall surface 32*a* of the inner container 32. Since individual sand grains are light in weight, the inner container 32 is not significantly damaged by the collision with the sand grains.

In the present embodiment, as described above, the cleaning explosive 1 is set in the center of the inner container 32 such that it is away from the inner wall surface 32*a* of the inner container 32. Therefore, as compared to the case where the cleaning explosive 1 is set on the inner wall surface 32*a* of the inner container 32, that is, set to be in contact with the inner wall surface 32*a*, the shock waves, high-temperature gas, and the sand 2 are distributed more uniformly to different parts of the inner wall surface 32*a* of the inner container 32. Therefore, the residue is decomposed or removed uniformly throughout the inside of the inner container 32.

The sand 2 is attached to cover the cleaning explosive 1. Thus, energy directed toward the outside of the cleaning explosive 1, that is, directed from the cleaning explosive 1 toward the inner wall surface 32*a* of the inner container 32 is applied to the sand 2. Therefore, as compared to the case where the sand 2 is attached inside the cleaning explosive 1, the sand 2 collides at higher velocity with the inner wall surface 32*a* of the inner container 32 and more reliably removes the adhering substances.

As described above, according to the present invention, by simply setting the cleaning explosive 1 and the separating material 2 inside the inner container 32 and exploding the cleaning explosive 1, the residue inside the inner container 32 can be partially discomposed and made harmless, and adhering substances which are remaining parts of the residue and adhere to the inner wall surface 32*a* of the inner container 32 can be removed from the inner wall surface 32*a*. In other words, both the decomposition of the residue and the removal of the adhering substances can be done by a single process. Therefore, after decomposing the residue by exploding the cleaning explosive 1, there is no need to perform an operation to remove the adhering substances adhering to and remaining on the inner wall surface 32*a* of the inner container 32. It is thus possible to clean the inside of the inner container 32 or the pressure tight container 10 in a short time. The adhering substances removed from the inner wall surface 32*a* float in the inner container 32 or accumulate at the bottom of the inner container 32, and thus can be easily removed from the inner container 32. To cause the separating material 2 to scatter to and collide with the inner wall surface 32*a* of the inner container 32, it may be possible to use an explosive, different from the cleaning explosive 1, for scattering the separating material. In this case, however, the explosive for scattering the separating material needs to be additionally set inside the inner container 32. On the other hand, in the present invention, where the cleaning explosive 1 is used to cause the separating material 2 to scatter to and collide with the inner wall surface 32*a*, it is possible to reliably reduce the processing time.

Figure 5:
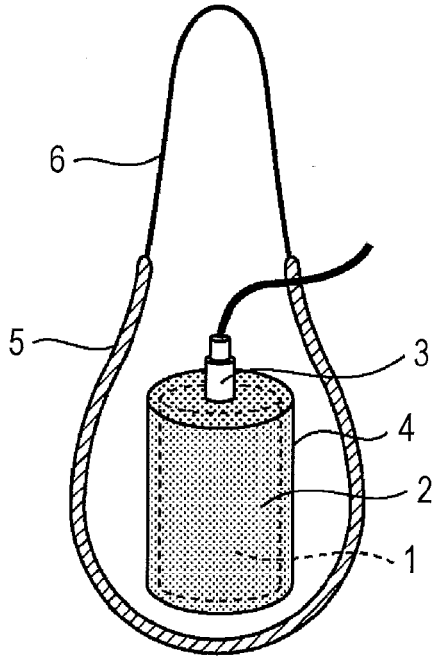
FIG. 5 is a diagram for explaining another method for setting the cleaning explosive and the separating material inside the pressure tight container.
Figure 6:
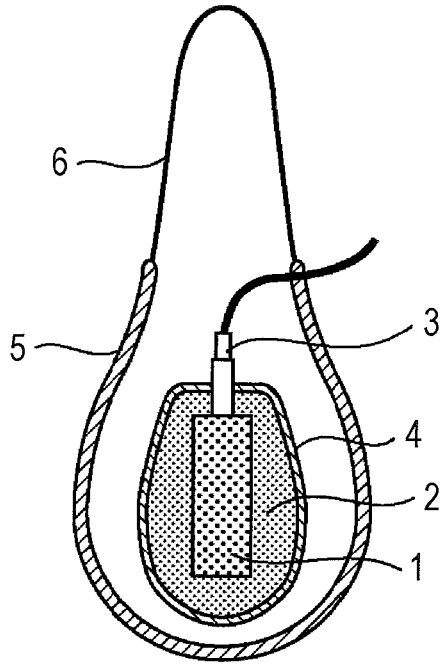
FIG. 6 is a diagram for explaining another method for setting the cleaning explosive and the separating material inside the pressure tight container.

The configuration used to set the cleaning explosive 1 and the sand 2, which serves as a separating material, inside the inner container 32 is not limited to that described above. For example, as illustrated in FIG. 5, the tubular cleaning explosive 1 wrapped therearound with the sheet-like bag 4 containing the sand 2 may be placed in the hanging bag 5. Alternatively, as illustrated in FIG. 6, the cleaning explosive 1 and the sand 2 may be placed in the bag 4 such that the cleaning explosive 1 is surrounded by the sand 2. Then, after the opening of the bag 4 is closed with plastic tape or the like, the bag 4 is placed in the hanging bag 5. The sand 2 alone or both the sand 2 and the cleaning explosive 1 may be placed in a non-flexible container.

Granular elements, such as the grains of sand, ceramic powder, or iron powder, compressed into a sheet may be used as the separating material 2, and the sheet of sand or the like may be placed around the cleaning explosive 1. However, if the separating material 2 composed of a plurality of granular elements is put in a container, such as a bag, and set, the separating material 2 is more reliably broken into a plurality of granular elements by exploding the cleaning explosive 1. It is thus possible not only to scatter the granular elements over a wider area, but also to more reliably suppress damage to the inner container 32.

Although the separating material 2 is placed to surround the cleaning explosive 1 in the embodiment described above, the relative position of the separating material 2 and the cleaning explosive 1 according to the present invention is not limited to this. For example, the separating material 2 and the cleaning explosive 1 may be positioned to be spaced apart. However, if the separating material 2 is placed to cover the cleaning explosive 1 as described above, the outward explosive energy of the cleaning explosive 1 is applied to the separating material 2. It is thus possible to scatter the separating material 2 at higher velocity to the inner wall surface 32*a* of the inner container 32.

Although the cleaning explosive is set in the center of the pressure tight container 10 in the embodiment described above, the present invention is not limited to this. For example, the cleaning explosive 1 may be placed to be in contact with the inner wall surface 32*a* of the inner container 32 (i.e., the inner wall surface of the pressure tight container 10) or may be placed at any position away from the inner wall surface. For example, if the pressure tight container is long in the direction of its axial center, the cleaning explosive 1 and the sand 2 attached thereto may be set at two or more different points, instead of only one.

In the embodiment described above, the residue is decomposed in the pressure tight container having a double-layer structure. However, the present invention is not limited to this, and is similarly applicable to the case where the residue is decomposed in a pressure tight container having a single or triple-layer structure, or in a pressure tight container having a double-layer structure with a different configuration.

The object to be blasted is not limited to that described above. For example, the present invention is applicable to cleaning of the inside of the pressure tight container 10 if the object to be blasted before the cleaning is an object that does not include at least one of the bursting charge (explosive) 112 and the chemical agent (hazardous substance) 121, or an object that is obtained by placing a hazardous substance such as organic halogen in a container.

Although the embodiment described above does not clearly indicate whether the same object to be blasted is blasted multiple times in blasting steps before the method of the present invention is performed, the object to be blasted may either be the same or different each time.

As described above, the present invention provides a method for cleaning the inside of a pressure tight container for blasting treatment, the method being performed after a blasting step in which an object to be blasted and a blasting explosive are set and blasted inside the pressure tight container. The method includes a setting step of setting a cleaning explosive different from the blasting explosive inside the pressure tight container after the blasting step, and setting a solid separating material inside the pressure tight container and at a position which allows the separating material to be scattered to an inner wall surface of the pressure tight container by explosion of the cleaning explosive and to collide with the inner wall surface of the pressure tight container, the separating material being capable of removing adhering substances adhering to the inner wall surface of the pressure tight container after the blasting step by colliding with the adhering substances; and a removing step of exploding the cleaning explosive inside the pressure tight container to partially decompose a residue of the object to be blasted remaining inside the pressure tight container after the blasting step, breaking the separating material into a plurality of granular elements, and causing the granular elements to scatter to and collide with different parts of the inner wall surface of the pressure tight container to remove the adhering substances.

According to the present invention, the residue can be partially decomposed by shock waves and high-temperature gas generated by explosion of the cleaning explosive. Additionally, it is possible to cause the separating material to scatter to and collide with the inner wall surface of the pressure tight container using the explosive energy of the cleaning explosive, and remove the adhering substances adhering to the inner wall surface of the pressure tight container. That is, by simply exploding the cleaning explosive, it is possible to simultaneously perform both decomposition of the residue in the pressure tight container and removal of the adhering substances adhering to the inner wall surface of the pressure tight container. Therefore, without using a special facility for removal of the adhering substances, the cleaning process including the removing process can be performed in a short time.

Specifically, in this method, the separating material is set at a position which allows the separating material to scatter to and collide with the inner wall surface of the pressure tight container in response to the explosion of the cleaning explosive. Therefore, the explosion of the cleaning explosive generates shock waves and high-temperature combustion gas of the cleaning explosive inside the pressure tight container, and a decomposable residue in the pressure tight container can be decomposed by the shock waves and high-temperature gas. Then, the explosion of the cleaning explosive causes the separating material to collide with the adhering substances adhering to the inner wall surface of the pressure tight container, and the collision causes the adhering substances to be removed from the inner wall surface of the pressure tight container. After the explosion of the cleaning explosive, there is no need for the operator to remove the adhering substances that adhere to the inner wall surface of the pressure tight container without being decomposed by the explosion. Thus, a reduction in processing time can be achieved. In particular, since the explosive energy of the cleaning explosive causes the separating material to scatter to and collide with the inner wall surface of the pressure tight container at high velocity, the adhering substances can be reliably removed in a short time.

In the present method, the separating material is broken into a plurality of granular elements, which scatter to and collide with the inner wall surface of the pressure tight container. Thus, the adhering substances adhering to different parts of the inner wall surface of the pressure tight container can be uniformly removed. At the same time, it is possible to suppress damage to the inner wall surface of the pressure tight container caused by the collision therewith.

According to the present invention, in the setting step, the separating material is preferably set inside the pressure tight container to at least partially cover the cleaning explosive.

Thus, the outward explosive energy of the cleaning explosive, that is, the explosive energy directed toward the inner wall surface of the pressure tight container can be efficiently applied to the separating material. This allows the separating material to scatter to and collide with the inner wall surface of the pressure tight container at higher velocity.

According to the present invention, in the setting step, the cleaning explosive and the separating material are preferably set at a position away from the inner wall surface of the pressure tight container.

Thus, as compared to the case where the cleaning explosive and the separating material are set to be in contact with the inner wall surface of the pressure tight container, the separating material and the shock waves and high-temperature gas generated by the explosion of the cleaning explosive are distributed more uniformly to different parts of the inner wall surface of the pressure tight container. This means that the inside of the pressure tight container can be cleaned more uniformly.

According to the present invention, the setting step preferably includes placing the plurality of granular elements forming the separating material in a separation container different from the pressure tight container, and setting the separation container containing the plurality of granular elements inside the pressure tight container such that the plurality of granular elements are placed around the cleaning explosive.

In this method, where the separating material is formed by a plurality of granular elements, the separating material can be reliably broken into granular elements and scattered. Upon receipt of the outward explosive energy of the cleaning explosive, the granular elements scatter to and collide with different parts of the inner wall surface of the pressure tight container at high velocity. It is thus possible not only to more reliably suppress damage to the inner wall surface, but also to more uniformly and reliably remove the adhering substances from the different parts of the inner wall surface.

In this case, if the plurality of granular elements forming the separating material are placed in a separation container having flexibility and the separation container is wrapped around the cleaning explosive, or if the cleaning explosive is placed in the separation container and the plurality of granular elements forming the separating material are placed in the separation container to surround the cleaning explosive, the plurality of granular elements forming the separating material can be easily placed around the cleaning explosive and at locations to which the outward explosive energy of the cleaning explosive can be transmitted efficiently.

As described above, according to the present invention, after the blasting step of blasting an explosive material, it is possible to simultaneously perform both decomposition of a residue in the pressure tight container and removal of the residue from the inner wall surface of the pressure tight container. Thus, the operation can be simplified and a reduction in processing time can be achieved.

The invention claimed is:

1. A Method for cleaning the inside of a pressure tight container for blasting treatment, the method being performed after a blasting step in which an object to be blasted and a blasting explosive are set and blasted inside the pressure tight container, the method comprising:

a setting step of setting a cleaning explosive different from the blasting explosive inside the pressure tight container after the blasting step, and setting a solid separating material formed by a plurality of granular elements inside the pressure tight container and at a position which allows the separating material to be scattered to an inner wall surface of the pressure tight container by explosion of the cleaning explosive and to collide with the inner wall surface of the pressure tight container, the separating material being capable of removing adhering substances adhering to the inner wall surface of the pressure tight container after the blasting step by colliding with the adhering substance; and a removing step of exploding the cleaning explosive inside the pressure tight container to partially decompose a residue of the object to be blasted remaining inside the pressure tight container after the blasting step, wherein the removing step causes the granular elements to scatter to and collide with different parts of the inner wall surface of the pressure tight container to remove the adhering substances.

2. The method for cleaning the inside of the pressure tight container for blasting treatment according to claim 1, wherein in the setting step, the separating material is set inside the pressure tight container to at least partially cover the cleaning explosive.

3. The method for cleaning the inside of the pressure tight container for blasting treatment according to claim 1 or 2, wherein in the setting step, the cleaning explosive and the separating material are set at a position away from the inner wall surface of the pressure tight container.

4. The method for cleaning the inside of the pressure tight container for blasting treatment according to claim 1, wherein the setting step includes placing the plurality of granular elements forming the separating material in a separation container different from the pressure tight container, and setting the separation container containing the plurality of granular elements inside the pressure tight container such that the plurality of granular elements are placed around the cleaning explosive.

5. The method for cleaning the inside of the pressure tight container for blasting treatment according to claim 4, wherein the setting step sets the separation container inside the pressure tight container with the separation container wrapped around the cleaning explosive.

6. The method for cleaning the inside of the pressure tight container for blasting treatment according to claim 4, wherein the setting step includes placing the separating material and the cleaning explosive in the separation container such that the cleaning explosive is surrounded by the plurality of granular elements forming the separating material, and setting the separation container inside the pressure tight container.

* * * * *